United States Patent [19]

Flory

[11] 4,258,349

[45] Mar. 24, 1981

[54] DOUBLE-POLE ROCKER SWITCH WITH THERMAL PROTECTION

[75] Inventor: Josef Flory, Reussbühl, Switzerland

[73] Assignee: Weber A.G. Fabrik Elektrotechnischer Artikel und Apparate, Emmenbrücke, Switzerland

[21] Appl. No.: 72,612

[22] Filed: Sep. 5, 1979

[30] Foreign Application Priority Data

Sep. 5, 1978 [CH] Switzerland ..... 9316/78

[51] Int. Cl.[3] ..... H01H 71/16; H01H 73/06

[52] U.S. Cl. ..... 337/46; 337/59; 337/113

[58] Field of Search ..... 337/3, 36–39, 337/41, 45, 46, 47, 59, 64, 70, 98, 112, 113; 200/3; 29/622; 335/43

[56] References Cited

U.S. PATENT DOCUMENTS

| | | | |
|---|---|---|---|
| 2,668,206 | 2/1954 | Edmunds | 29/622 |
| 2,866,026 | 12/1958 | Bingenheimer | 337/46 |
| 3,143,617 | 8/1964 | Ellenberger | 337/112 |
| 3,475,711 | 10/1969 | Stokes | 337/45 |

*Primary Examiner*—William H. Beha, Jr.
*Attorney, Agent, or Firm*—Browdy & Neimark

[57] ABSTRACT

A double-pole rocker switch with thermal overload protection is constructed as a fully functional sub-assembly which may be tested and adjusted prior to insertion in a tubular housing. The sub-assembly is held in the housing by releasable locks for subsequent servicing. All component elements of the switch are carried on the sub-assembly, including all electrical contacts. In particular, the sub-assembly has a base in which two pairs of electrical contacts are fixedly disposed, each pair being contacted by a spring-loaded contact bridge in one position of the rocker. This position can be attained, however, only if a movable contact block is held at one end by a fulcrum provided by a latch. The latch pivots in a V-shaped groove and may be removed from engagement with the contact block by a bimetallic strip under conditions of overload. In that condition, even deliberate actuation of the rocker cannot result in a closure of the switch because of the absence of the fulcrum.

9 Claims, 8 Drawing Figures

DOUBLE-POLE ROCKER SWITCH WITH THERMAL PROTECTION

FIELD OF THE INVENTION

The invention relates to electrical switches, in particular to a double-pole, double-throw rocker switch with a built-in bimetallic release element which breaks the electrical connection of the switch when an overload occurs. The rocker is spring-loaded and moves a contact block to effect the switch closure. The bimetallic element engages the contact block in a manner to prevent switch closure after an overload occurs.

BACKGROUND AND PRIOR ART

Thermally protected switches of the general type described above are known and are available in commerce. In switches of this type, the switch housing is constructed of two separate parts, i.e., a surrounding housing shell and a cover or lid. In other instances, the switch is composed of two housing shells which are permanently joined together after assembly of the internal switch elements, for example by riveting, welding, gluing or by a non-releasable snap connection. When this type of housing is sealed, it is thereafter impossible to engage internal elements of the switch for the purpose of adjustment or calibration without damaging a part of the housing or without tedious removal of the rivets which hold the housing parts together. On the other hand, the switch mechanism cannot be adequately tested prior to assembly nor can it be calibrated because the switch mechanism depends on numerous interacting and load-bearing elemens which are part of the housing and are not available to the switch mechanism until it is fully assembled.

OBJECT AND SUMMARY OF THE INVENTION

It is thus an object of the present invention to provide a rocker switch of the general type described above which is accessible for adjustment or calibration before being finally assembled. It is an associated object of the invention to provide a switch which is simple in construction having few component parts.

These and other related objects of the invention are attained by providing a rocker switch with a one-piece housing forming a channel that receives and holds an integral slide of insulated material including a subdivided base on which a number of elements, for example the fixed electrical contact elements, a support assembly for the bimetallic thermally protected elements, etc., are disposed. The integral switch mechanism includes a contact block which is urged away from the electrical contact by a contact spring and the base has lateral supports for pivotal mounting of the rocker as well as of an intermediate toggle mechanism connecting the rocker and the contact block. Inasmuch as all of the operational components of the switch are mounted on the removable switch mechanism and the function of the switch elements is not related to and does not depend on any part of the switch housing, the switch mechanism may be adjusted or calibrated very easily prior to final assembly in the housing. The housing and/or the removable switch mechanism can be provided with a releasable lock which permits removal of the switch mechanism from its housing subsequent to assembly.

Other features and advantages of the invention will emerge from a detailed description of two preferred although merely exemplary embodiments of the invention which relates to the drawing.

DESCRIPTION OF THE PREFERRED EMBODIMENTS

Figure 1:
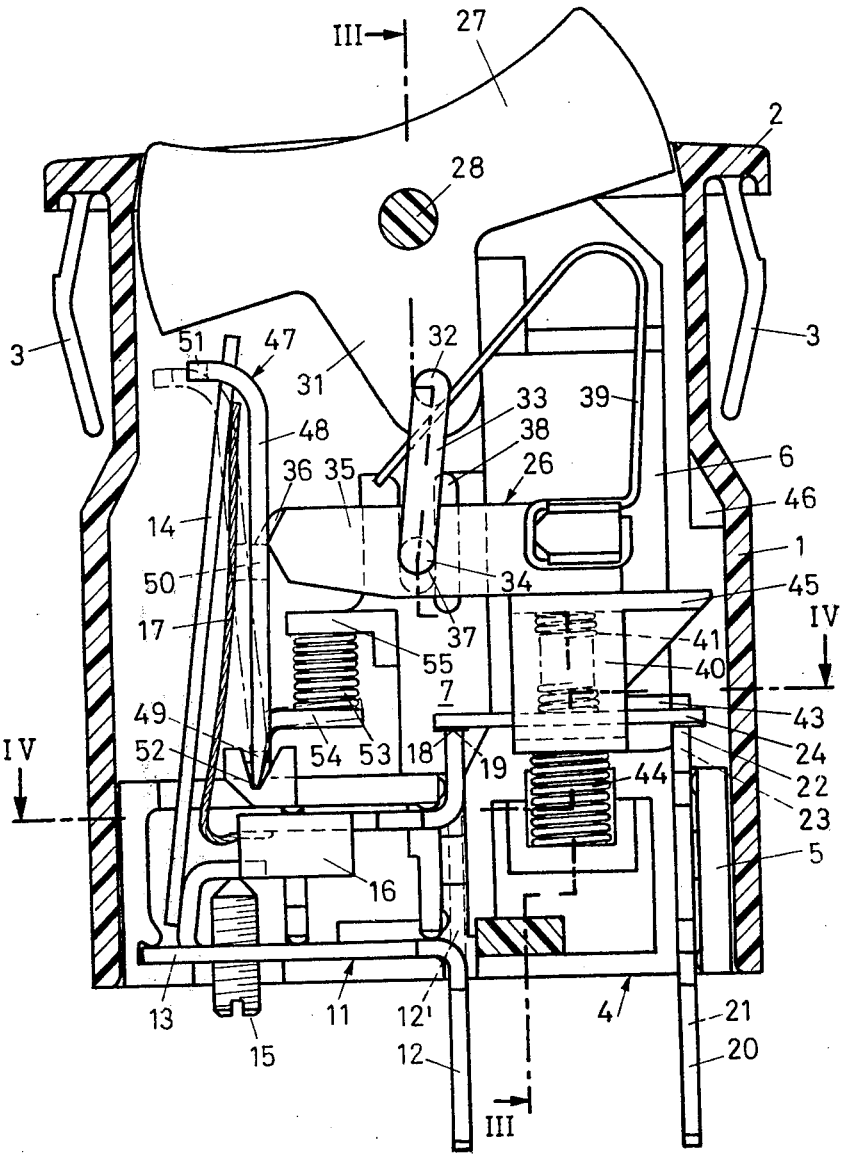
FIG. 1 is a cross-sectional view of a first switch according to the invention in the closed, i.e., conducting, state and represents a section along the line I—I in FIG. 3.

The switch illustrated in FIGS. 1 to 4 of the drawing has an integral housing 1, made for example of an insulating plastic material, and having the cross-sectional shape of a rectangular tubing with open ends. External tabs 3 attached to the edges of one open end of the housing serve to engage a rectangular opening in an armature plate or the like in which the switch is inserted for use.

Figure 3:
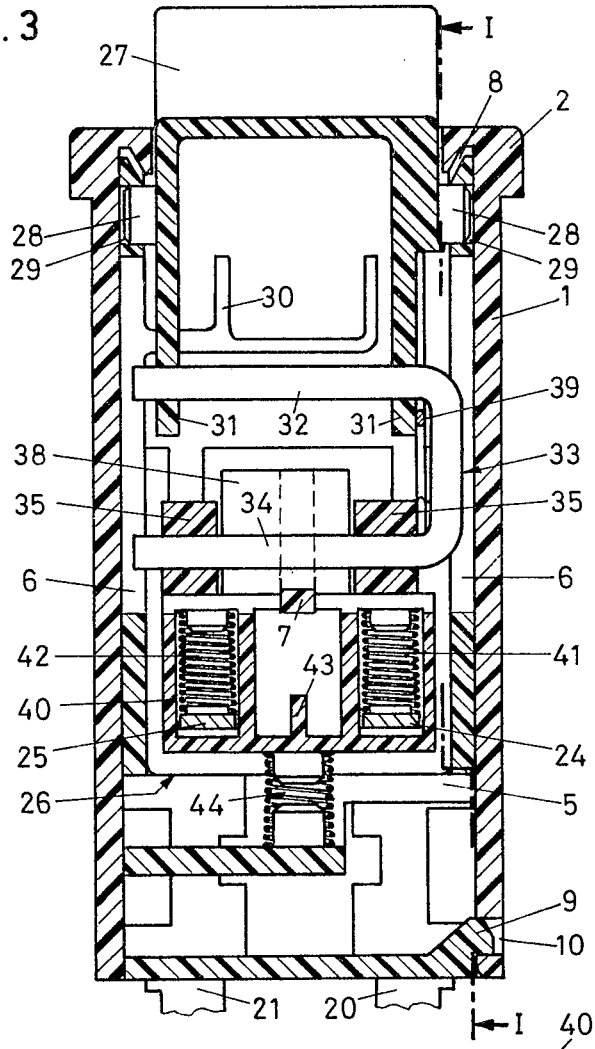
FIG. 3 is a section of the switch along the line III—III of FIG. 1.
Figure 4:
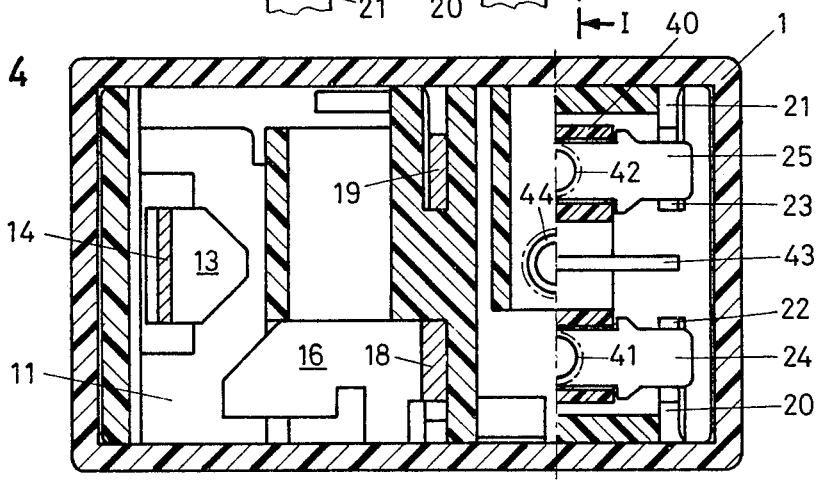
FIG. 4 is a section of the switch along the line IV—IV in FIG. 1.

Contained within the housing 1 is an integral switch assembly 4 whose major structural component is a piece of plastic insulating material on which all the elements of the switch mechanism including the contacts are amounted captively. The basic structure of the element 4 is a multi-partite base 5 with an external shape resembling a parallelepiped having narrow lateral walls 6 as well as a shorter central carrier wall 7. As best seen in FIG. 3, the lateral carrier walls 6 are guided in upper grooves 8 of the edge 2 of the housing. The lower edge of the base 5 has cams 9 which engage openings 10 of the housing 1 so as to hold the assembly forward in the housing 1 in a firm manner but permitting subsequent removal by slight outward bending of the lower edge of the housing 1.

The base 5 is provided with a number of insulating slots, protrusions and passages which serve to hold in place various strip-shaped or plate-like metal parts to be described below. A first such part 11 is a single conducting multiply bent part having an external tab 12 which extends from the base 5 connected to a carrier 13 for a strip-shaped bimetallic element 14. A calibrating screw 15 is threaded into the carrier 13 for adjusting the element 14.

Disposed above the bimetallic carrier 13 is a connector that is coupled electrically to the bimetallic element 14 via a braided wire 17. An upwardly bent end 18 of the connector 16 serves as a first fixed contact element. Simiarly, a second external tab 12' is located behind the tab 12 in FIG. 1 and thus invisible therein, and continues upwardly as a second fixed contact element 19 which may be seen in section in FIG. 4. The contact tabs 12 and 12′ are intended to be connected to a bipolar user device, for example some appliance.

The base 5 holds two further insulated electrical contact tabs 20 and 21 which are intended to connect the switch with two poles of a current source, for example the A.C. power line. The upper ends 22 and 23 of the tabs 20 and 21, respectively, serve as third and fourth fixed contact elements, respectively.

Each pair of associated contact elements, i.e., the pair of contacts 18 and 22 and the pair of contacts 19 and 23 may be electrically bridged by a movable contact bridge 24 and 25 respectively. In the closed position of the switch illustrated in FIG. 1, the pairs of contacts 18, 22 and 19, 23 are thus electrically connected by the respective contact bridges 24, 25. The contact bridges 24, 25 are disposed on a movable contact block 26 which will be described in detail below.

Figure 6:
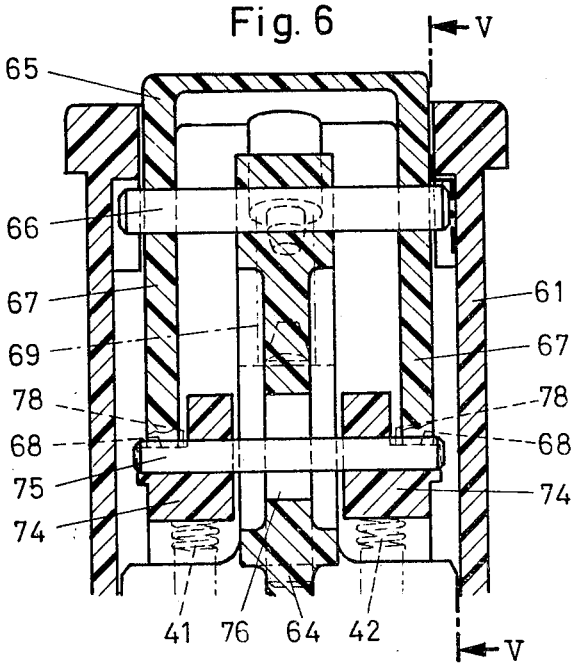
FIG. 6 is a section of the switch along the line VI—VI of FIG. 5.

The basic actuation of the switch is performed by pivoting a rocker 27 which is held by means of pins 28 in appropriate openings 29 of the two lateral carrier walls 6. The rocker 27 may be hollow and may be suitably constructed of a transparent or translucent and electrically insulating material so as to permit the installation therein of an indicating light, for example an incandescent lamp, which may be suitably held in a fork-shaped holder 30, as seen in FIG. 6.

The rocker 27 has two skirts 31 containing holes through which passes one leg 32 of a U-shaped loop 33. The second leg 34 of the loop 33 is pivotably attached to the aforementioned insulating contact block 26. The leg 34 is carried in the contact block 26 in two longitudinal struts 35 which are joined at the ends nearest the bimetallic element 14 by a bridge, not visible in the drawing, and extending into a protrusion 36. The second leg 34 of the loop 33 is also guided in a vertical slot 37 of the central carrier wall 7. In order to increase the support surface for the leg 34 within the slot 37, the longitudinal carrier 7 has a lateral plate-like support piece 38. The rocker 27 is urged into the position illustrated in FIG. 2 by a wire spring 39 which is anchored in the contact block 26 and which engages the upper leg 32 of the loop 33.

Figure 2:
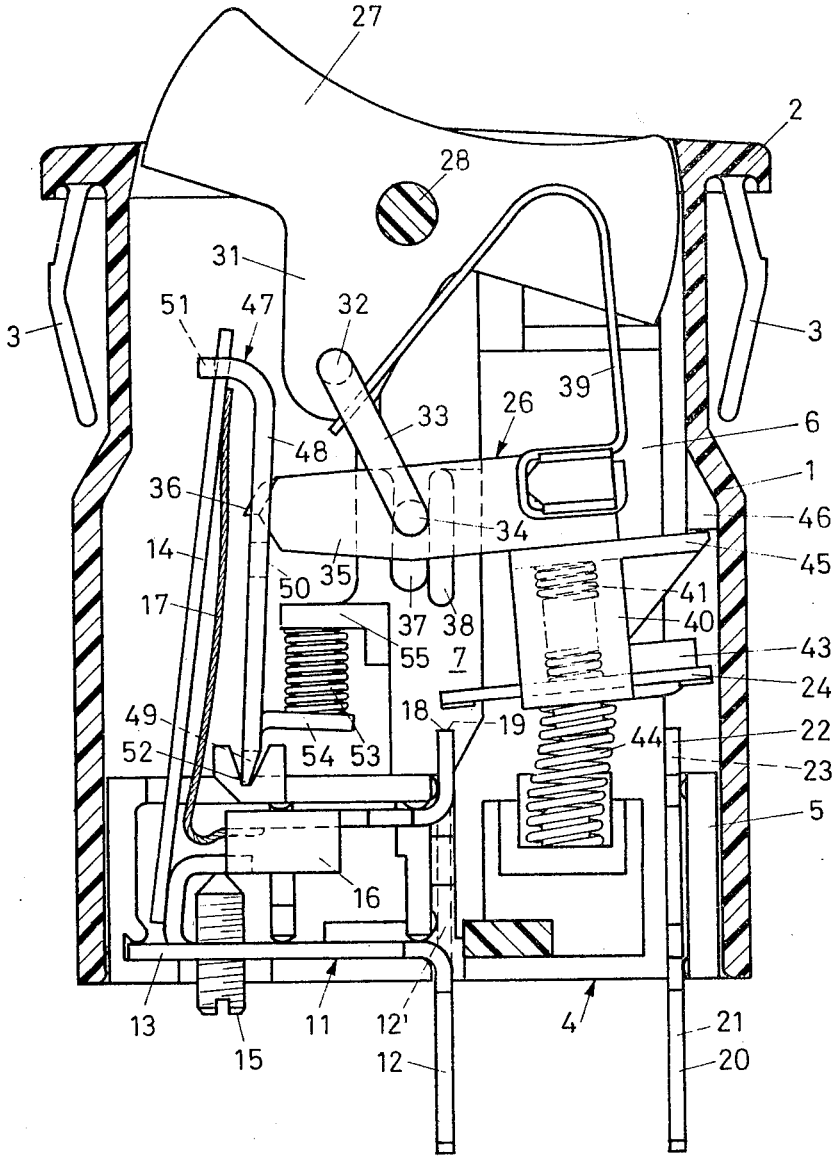
FIG. 2 is a view of the switch of FIG. 1 in the open or electrically non-conducting state.

The contact block 26 has a box-like member 40 which is integral with the upper longitudinal struts 35 and which defines three adjacent insulated chambers (FIG. 3). Each of the lateral chambers contains one of the two contact bridges 24, 25 which are subjected to the downward pressure of a contact spring 41, 42 which urges the bridges downwardly, as seen in FIG. 1, 2 and 3. The central chamber serves to insulate the two contact bridges 24, 25 from one another and is provided with a longitudinal insulating barrier 43. The contact block 26 pivots about the lower leg 34 of the loop 33 and is urged in a generally counterclockwise rotation, i.e., upwardly in FIG. 1, by a return spring 44 supported on the base 5. At the end of the contact block remote from the protrusion 36, there is disposed an extension which limits the upward motion of the block 26 by contact with cams 46 which may be part of the housing 1 or which may be integral with the parts of the base plate 4, for example the longitudinal walls 6.

The contact block 26 is held in its switch-closing position by a latch 47 which has two longitudinal struts 48, only one of which is visible in FIGS. 1 and 2, and three lateral bridges 49, 50 and 51. The lowest cross bridge 49 serves to provide a pivotal bearing for the latch 47 in a V-shaped groove 52 of the base 5. A latch spring 53 which is supported on a tab 54 bent out from the latch 47 bears against a support 55 of the central longitudinal carrier wall and thus holds the latch 47 firmly in the V-shaped groove 52. At the same time, the spring 53 urges the latch 47 to bear against the protrusion 36 in the vicinity of the lateral bridge 50 of the latch 47. The upper lateral bridge 51 as well as the ends of the longitudinal struts 48 surround the free end of the bimetallic element 14 so that when a thermal condition occurs which moves the bimetallic element 14 in the counterclockwise sense, as seen in FIG. 1, the bimetallic element carriers along the latch 47, thereby pivoting it counterclockwise in its V-shaped groove 52.

The function of the switch described above is as follows. In the closed condition of the switch, i.e., the electrically conducting condition, the contact block 26 is latched. Even though the return spring 44 urges one end of the contact block 26 upwardly, the latter is unable to pivot or move because its protrusion 36 engages the lateral bridge 50 of the latch 47 while the loop 33 is unable to either pivot or move upwardly, being prevented from doing so by the terminal position of the rocker 27. Accordingly, the contact springs 41, 42 press the contact bridges 24, 25 onto the associated fixed contact elements 18, 22 and 19, 23 and thus provide an electrical connection from the tab 20 to the tab 12 and from the tab 21 to the tab 12′. The current through the bridge 24 passes through the bimetallic element 14 before being passed to the output tab 12. If the current passing through the bimetallic element 14 is excessive, the latter pivots in the counter-clockwise sense into the position indicated in dash-dotted lines in FIG. 1. During the motion, it pulls along the latch 47 whose lateral bridge 50 disengages from the protrusion 36, thereby permitting the return spring 44 to pivot the contact block 26 abruptly about its pivot on the loop 33 and thus lifting the contact bridges 24, 25 from the fixed contact posts 18, 22 and 19, 23. Furthermore, the rocker spring 39 is now able to pivot the loop 33 in the counterclockwise sense, thereby placing the rocker 27 into the opposite terminal position, as illustrated in FIG. 2. During this motion, the extension 45 of the block 26 makes contact with the cams 46. Accordingly, the protrusion 36 of the block 26 remains above the lateral bridge 50 of the latch 47 so that when the bimetallic element 14 cools off and returns into the solidly drawn position of FIG. 1, and the latch 47 returns in the direction of the protrusion 36 as urged by the spring 53, the lateral bridge 50 again comes into mechanical contact with the protrusion 36 and is able to serve as a fulcrum if the rocker 27 is returned to the closed position of the switch, i.e., the position illustrated in FIG. 1. However, if the bimetallic element 14 has not returned to its normal, cold position, the switch according to the invention may not be closed even if the rocker is actuated, for, in that case, the protrusion 36 merely passes the lateral bridge 50 without contact. Thus the contact block 26 is able to pivot about the lower leg of the loop 33 and is thus prevented by the spring 44 from placing the contact bridges into electrical contact with the fixed contact posts of the switch.

It will be appreciated that the construction of the switch in separate major parts, i.e., a housing 1 separate from the insertable switch assembly 4, permits a relatively simple and unimpeded installation and assembly of all component parts of the switch mechanism as well as a testing of the functions of the switch and, if required, an adjustment prior to installation in the housing 1. Furthermore, if subsequent inspection, testing or adjustment is required, the assembly 4 may be simply removed from the housing without destruction of any parts of the housing or the switch because no permanent joints such as welds, screw or rivet connections, etc., between the housing 1 and the assembly 4 are required. The construction of the latch 47 in its V-shaped pivot groove 52 makes it possible for the latch spring 53 to serve a dual role, namely, the firm positioning of the latch 47 in the bearing, as well as causing the latch 47 to exert pressure against the protrusion 36 of the contact block 26.

The illustrated embodiment shows the stop or extension 45 which cooperates with the cams 46 to be disposed on or part of the housing 1; however, as already mentioned above, these cams 46 may also be made part of the assembly 4, for example part of the lateral walls 6. However, even in the construction illustrated, the entire switch may be tested in the disassembled condition, i.e., with the assembly 4 removed from the housing 1 by providing a temporary stop element on the assembly 4 to serve the function of the cams 46.

Figure 7:
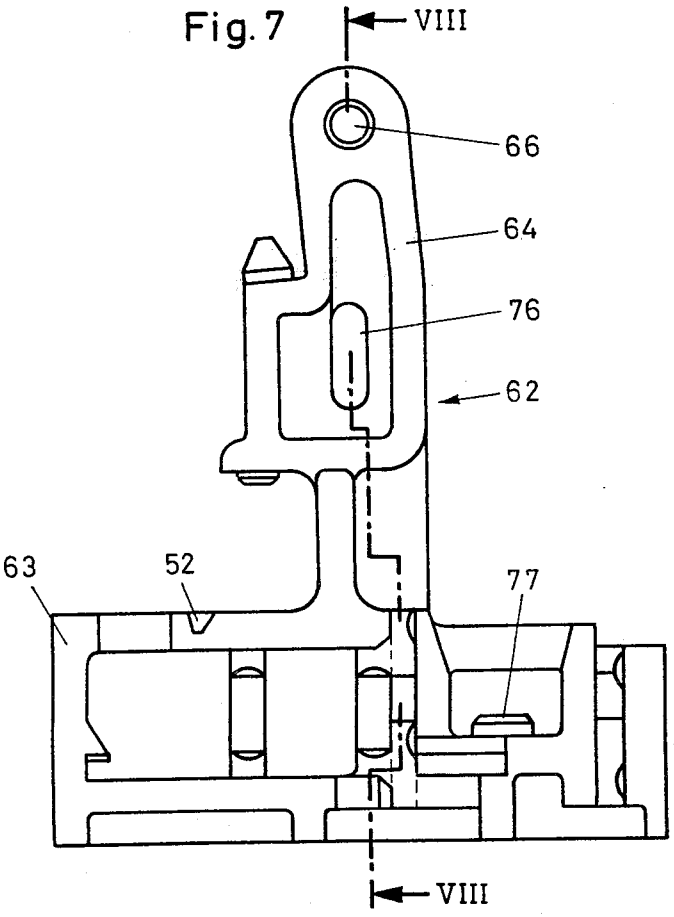
FIG. 7 is a view of an integral slide of insulating material of the switch of FIG. 5.
Figure 8:
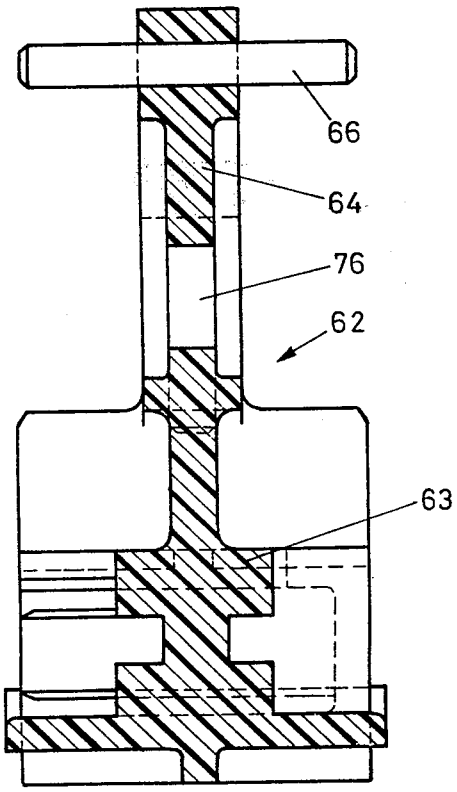
FIG. 8 is a section of the integral slide along the line VIII—VIII of FIG. 7.

The further embodiment of the switch according to the invention as illustrated in FIGS. 5 to 8 again comprises an integral housing 61 of an insulating plastic material (FIGS. 5, 6), the housing having a rectangular cross-section and open ends. An integral slide 62 (FIGS. 7, 8) of insulating plastic material is inserted into the housing 61 and held therein. The slide 62 includes a lower base 63 which is similar to the base 5 of FIGS. 1 to 4, and a single upright carrier wall 64. The base 63 is not shown in FIGS. 5 and 6, because it assumes the same function and carries the same metal parts as the base 5 of FIGS. 1 to 4. The carrier wall 64 serves as a support both for a rocker 65 and an insulating contact block 70.

The rocker 65 is pivotally supported in the uppermost portion of the carrier wall 64 by means of a first pin 66. The rocker 65 is again formed as a hollow body having two skirts 67 with lower ends 68. A spring 69 supported by the carrier wall 64 tends to urge the rocker 65 into its open or off position (not shown).

The contact block 70 generally has the same form as the contact block 26 shown in FIG. 1 except for its function as a support for the rocker spring. It comprises a first elongated portion 71 and a second box-like portion 72 integrally formed thereto. The portion 71 again shows a protrusion 73 engaging the latch 47 which holds the contact block 70 in its switch-closing position and which at its lower end (not shown) is pivotally supported in a V-shaped groove 52 (FIG. 7) of the base 62. As in FIG. 1, the upper end of the latch 47 surrounds the free end of the bimetallic element 14 to which current is supplied via the braided wire 17.

The elongated portion 71 of the contact block 70 comprises two longitudinal struts 74 (FIG. 6) which carry a second pin 75. The pin 75 is guided in a vertical slot 76 of the carrier wall 64. The box-like portion 72 of the contact block 70 comprises the contact springs 41, 42 of FIGS. 1 and 3 which urge the contact bridges 24, 25 (not shown in FIGS. 5, 6) downwardly. The contact block 70, as described in connection with FIGS. 1 and 3, is urged in a generally counterclockwise rotation, i.e., upwardly in FIG. 5, by a return spring which is not shown in FIG. 5, a support 77 for which in the base 63 is shown, however, in FIG. 7. Therefore, faces 78 of the contact block 70 lie against the ends 68 of the skirts 67 of the rocker 65 as can be seen in FIGS. 5 and 6.

When excessive current in the bimetallic element 14 results in a counterclockwise rotation of the bimetallic element and, consequently, the latch 47, the latter disengages from the contact block 70, thereby permitting the return spring (not shown) to pivot the contact block 70 abruptly about its pivot on the pin 75 and thus lifting the contact bridges from the fixed contact posts (not shown) as has been described in connection with FIG. 1. The rocker spring 69 is now able to pivot the rocker 65 in the clockwise sense, whereby the ends 68 of the skirts 67 of the rocker 65 reach a position on the other side, i.e., on the left side, of pin 75. The latter position is indicated in FIG. 5 by a dash-dotted line 79. Therefore, the pin 75 and the contact surfaces 78 and 68 of the contact block 70 and the skirts 67 of the rocker 65, respectively, represent a toggle mechanism or link, which is equivalent to the link represented by the loop 33 in FIGS. 1 and 2. The substitution of the pin 75 of FIGS. 5, 6 for the loop 33 of FIGS. 1, 2 has the advantages of lower manufacturing costs and higher precision as a simple pin can be made within narrower tolerances than a U-shaped loop.

Figure 5:
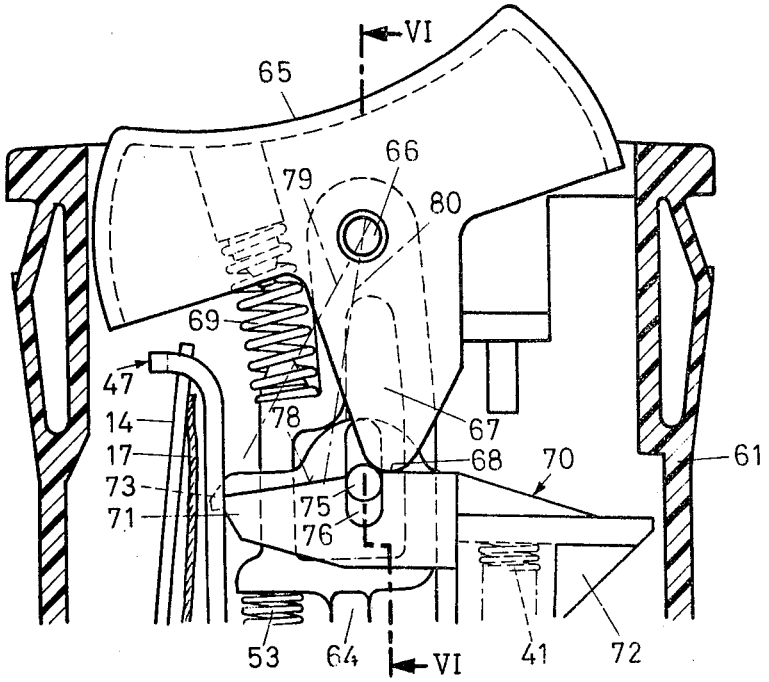
FIG. 5 is a partial cross-sectional view of a second switch according to the invention in the closed, i.e., conducting, state.

When the rocker 65 is returned to the closed position of the switch, i.e., the position illustrated in FIG. 5, the ends 68 of the skirts 67 of the rocker 65 again glide on the surfaces 78 of the contact block 70 from the left to the right side with respect to the pin 75. As the pin 75 slightly protrudes from the surfaces 78, a resistance to further motion will be sensed when the ends 68 of the skirts 67 come into contact with the pin 75. That position of the rocker 65 is indicated in FIG. 5 by a further dash-dotted line 80. In that position of the rocker 65, the contact bridges close the fixed contact posts, but open them immediately when the rocker 65 is released, thereby returning to its postion indicated by the dash-dotted line 79. Therefore, the switch of FIGS. 5 to 8 may be operated in a push-button manner. To definitely lock the switch in its closed position, an increased pressure has to be applied to the rocker 65 in order to surmount the mechanical resistance represented by the protruding pin 75.

The presence of a single carrier wall 64 in the embodiment of FIGS. 5 to 8 instead of three carrier walls in the embodiment of FIGS. 1 to 4 results in a slide 62 of increased mechanical rigidity. For the same reason, the costs of the tool for moulding the slide 62 are drastically reduced.

The foregoing description relates to preferred exemplary embodiments of the invention in which changes, variations, etc. are possible without departing from the spirit and scope of the invention.

What is claimed is:

1. A double-pole rocker switch with thermal overload protection, of flat parallelepiped form, including a toggle at one narrow end thereof and electrical contact members at the other narrow end thereof and further including a pivotable spring-loaded contact block coupled pivotably to said rocker via a toggle mechanism, said contact block supporting at the end remote from said toggle mechanism two movable contact elements which cooperate with stationary contact elements, said contact block being lockable by a pivotable latch which is displaceable by a bimetallic element and wherein, according to the invention, said switch comprises a unitary tubular housing (1;61) of approximately rectangular cross-section surrounding a slidably insertable singlepiece slide assembly (4;62) including an insulated subdivided base member (5;63) which supports external electrical contacts (12,12',20,21) and internal electrical contacts (18,22,19,23) and which further supports a spring (44) which loads said springloaded contact block (26;70) and defining a pivotal bearing (52) for said pivotable latch (47), said base member (5;63) having at least one carrier wall (6,7;64) for supporting said rocker (27;65) and for guiding a pin member (34;75) forming part of said toggle mechanism, said pin member (34;75) being longitudinally displaceable in said carrier wall (7;64) and pivotally supporting said contact block (26;70).

2. A switch according to claim 1 wherein said toggle mechanism comprises a U-shaped loop (33) a first leg (32) of which is supported in said rocker (27) and the scond leg (34) of which is pivotally attached to said contact block (26), and wherein two lateral carrier walls (6) supporting said rocker (27) and one central carrier wall (7) guiding said second leg (34) of said U-shaped loop (34) are integrally formed with said base member (5) of said slide assembly (4).

3. A switch according to claim 1 wherein a single carrier wall (64) is integrally formed with said base member (4), a first pin (66) being disposed in the upper portion of said carrier wall (64) for pivotally supporting said rocker (65), a slit (76) extending longitudinally of said carrier wall (64) being formed in a medium portion of said carrier wall (64), a second pin (75) supporting said contact block (70) being disposed in said slit (76), and wherein said contact block (70) comprises gliding surfaces (78) for an extension (67) of said rocker (65), said extension (67) having end portions (68) extending in the direction of said base member (63), spring means (44) urging said gliding surfaces (78) of said contact block (70) against said end portions (68) of said extension (67) in such manner that said end portions (68) of said extension (67) in a first of two positions of said rocker (65) are located, on said gliding surfaces (78) of said contact block (70), on the one side of said second pin (75) and in the second position of said rocker (65) are located, on said gliding surfaces (78) of said contact block (70), on the other side of said second pin (75).

4. A switch according to claim 3 wherein said rocker (65) comprises two lateral skirts (67) having respective end portions (68), said first pin (66) being supported by said skirts (67), and wherein said contact block (79) comprises two longitudinal struts (74) having gliding surfaces (78) for said end portions (68) of said skirts (67), said second pin (75) being disposed in said contact block (70) in such manner that its cross section partially protrudes beyond said longitudinal struts (74) for presenting a mechanical resistance to said end portions (68) of said skirts (67) when said rocker (65) is moved from its one to its other of its two positions.

5. A switch according to claim 1, wherein said base member (5;63) has a plurality of slots and passages for supporting and locating said external contacts (12,12',20,21), three of which (12',20,21) also define said stationary contacts (19,22,23) and the fourth of which (12) defines a carrier (13) which carries said bi-metallic element (14).

6. A switch according to claim 5, wherein said internal electrical contact (18) is defined by a connector (16) held in said base member (5;63) and connected to said bi-metallic element (14) by a flexible conductor (17).

7. A switch according to claim 6, wherein said two movable contact elements attached to said contact block (26;70) are springloaded contact bridges (24,25) which cooperate, respectively, with pairs (18,22, and 19,23) of said stationary contacts.

8. A switch according to claim 1, wherein said base member (5;63) defines a groove (52) in which pivots said latch (47) subject to the force of a spring (53) which also urges said latch (47) toward said contact block (26;70).

9. A switch according to claim 8, wherein said latch (47) is composed of two longitudinal struts (48) connected by three lateral struts (49,50,51), the lateral strut (49) remote from said toggle residing in said groove (52) and the middle lateral strut (50) cooperating with a protrusion (36;73) of said contact block (26;70) while the upper lateral strut (51) makes contact with the free end of said bi-metallic element (14); whereby, when said bi-metallic element (14) moves away from said contact clock (26;70), said latch (47) is removed from said contact block (26;70).

* * * * *